US009759409B2

(12) United States Patent
Durdle et al.

(10) Patent No.: US 9,759,409 B2
(45) Date of Patent: Sep. 12, 2017

(54) LIGHT EMITTING DIODE (LED) LIGHTING FIXTURE HAVING TOOL-LESS LIGHT ENGINE MODULE

(71) Applicant: LED Roadway Lighting Ltd., Halifax, Nova Scotia (CA)

(72) Inventors: Matthew Durdle, Dartmouth (CA); Tristan Laan, Lewis Lake (CA); Jeremy Marchand, Halifax (CA); Charles Andrew Cartmill, Halifax (CA)

(73) Assignee: LED Roadway Lighting Ltd. (CA)

( * ) Notice: Subject to any disclaimer, the term of this patent is extended or adjusted under 35 U.S.C. 154(b) by 0 days.

(21) Appl. No.: 14/422,285

(22) PCT Filed: Aug. 22, 2013

(86) PCT No.: PCT/CA2013/050646
§ 371 (c)(1),
(2) Date: Feb. 18, 2015

(87) PCT Pub. No.: WO2014/029024
PCT Pub. Date: Feb. 27, 2014

(65) Prior Publication Data

US 2015/0219320 A1 Aug. 6, 2015

Related U.S. Application Data

(60) Provisional application No. 61/692,007, filed on Aug. 22, 2012, provisional application No. 61/692,019, filed on Aug. 22, 2012.

(51) Int. Cl.
*F21V 17/18* (2006.01)
*F21S 8/08* (2006.01)
(Continued)

(52) U.S. Cl.
CPC ..... *F21V 17/18* (2013.01); *F21S 8/086* (2013.01); *F21V 5/007* (2013.01); *F21V 19/003* (2013.01);
(Continued)

(58) Field of Classification Search
CPC ..... F21Y 2101/02; F21W 2131/103; F21V 19/003; F21V 19/0035; F21V 17/18;
(Continued)

(56) References Cited

U.S. PATENT DOCUMENTS 4,432,045 A 2/1984 Merritt
6,805,470 B1 10/2004 Ward
(Continued)

FOREIGN PATENT DOCUMENTS

CA 2247962 A1 9/1997
CA 2736395 A1 3/2010
(Continued)

OTHER PUBLICATIONS

Malgorzata Samborski; PCT/CA2013/050646; International Search Report; Nov. 13, 2013; Canadian Intellectual Property Office, Quebec, Canada.
(Continued)

*Primary Examiner* — Robert May
(74) *Attorney, Agent, or Firm* — Stevens & Showalter, LLP

(57) ABSTRACT

A light fixture is provided. The light fixture contains a light engine module having a printed circuit board with a plurality of light sources and a lens module having a plurality of lens elements for the plurality of light sources, a housing for the light engine module, and a latch engaged with the housing, the latch locking and unlocking the lens light engine module with the housing.

21 Claims, 18 Drawing Sheets

(51) Int. Cl.

| | |
|---|---|
| ***F21V 19/00*** | (2006.01) |
| ***F21V 5/00*** | (2015.01) |
| *F21W 131/103* | (2006.01) |
| *F21Y 115/10* | (2016.01) |

(52) U.S. Cl.
CPC ... *F21V 19/0015* (2013.01); *F21W 2131/103* (2013.01); *F21Y 2115/10* (2016.08)

(58) Field of Classification Search
CPC .... F21V 5/007; F21V 19/004; F21V 19/0045; F21V 17/16; F21V 17/162; F21V 17/164; F21V 17/166; F21V 17/168
USPC ..... 362/612, 97.3
See application file for complete search history.

(56) References Cited

U.S. PATENT DOCUMENTS 8,408,743 B1 * 4/2013 Chen ..... F21V 29/20 362/249.02
8,585,258 B2 * 11/2013 Ham ..... F21V 29/20 362/294
8,864,344 B2 * 10/2014 Jiang ..... F21V 5/04 362/309
2008/0298058 A1 * 12/2008 Kan ..... F21V 15/01 362/240

FOREIGN PATENT DOCUMENTS

CA 2762738 A1 6/2012
EP 2383508 A1 2/2011

OTHER PUBLICATIONS

Malgorzata Samborski; PCT/CA2013/050646; Written Opinion of the International Searching Authority; Nov. 13, 2013; Canadian Intellectual Property Office, Quebec, Canada.

* cited by examiner

LIGHT EMITTING DIODE (LED) LIGHTING FIXTURE HAVING TOOL-LESS LIGHT ENGINE MODULE

CROSS-REFERENCE TO RELATED APPLICATION

This application claims priority from U.S. Provisional Application No. 61/692,007 filed Aug. 22, 2012 and U.S. Provisional Application No. 61/692,019 filed Aug. 22, 2012, the contents of which are both hereby incorporated by reference.

TECHNICAL FIELD

The present disclosure relates to light fixtures and in particular to an LED lighting fixture light fixtures for illuminating large area applications using emitting diode light fixtures.

BACKGROUND

Light fixtures or luminaries that are used for illuminating large areas such as a road, street, or motorway must meet a number of lighting requirements in relation to coverage, efficiency and light control. Various standards have been developed to define the light output pattern produce optimal distribution which meets Illuminating Engineering Society of North America (IESNA) specifications for both luminance and illuminance levels and uniformity provided and specifications have been designed for improved light pollution control such as International Dark-Sky Association. Light emitting diode (LED) technologies have become more prevalent in large area applications as the need to increase energy efficiency, however as opposed to high intensity discharge (HID), such as sodium vapor lamps which provide a single light source having a single light source, LED based fixtures present a challenge in meeting lighting requirements as multiple light sources are incorporated in a single device. During the lifetime of a light fixture the LED light engine will need to be replaced due to component failure, degradation, future upgrades to more efficient components, or changes in user requirements. Therefore, there is a need to provide a roadway light fixture that allows for quick replacement of its components such as the light engine.

SUMMARY

In accordance with an aspect of the present disclosure there is provided a light fixture comprising: a housing for accommodating a light engine module, the light engine module comprising a lens module having a plurality of lens elements mounted on a plurality of light sources; and a latch engaged with the housing, the latch locking and unlocking the light engine module with the housing by being engaged and disengaged with the light engine module.

In accordance with another aspect of the present disclosure a light assembly for a light fixture, comprising: a latch on a housing of the light fixture; and a lens module comprising a plurality of lens elements for a plurality of light sources and a receiving member for receiving the latch, the latch releasably engaged with the receiving member of the lens module to lock and unlock the lens module mounted on the plurality of light sources within the housing.

In accordance with yet another aspect of the present disclosure a light engine module for light fixture, the light engine module comprising: a light engine comprising a plurality of light emitting diodes (LED); and a lens cover for mating with the light engine, the lens cover having a plurality of lens elements for receiving the plurality of LEDs, the lens cover having and a receiving portion for receiving a latch of the light fixture, the latch releasably engaged with the receiving portion of the lens module to lock and unlock the light engine module mounted within the housing.

BRIEF DESCRIPTION OF THE DRAWINGS

Further features and advantages of the present disclosure will become apparent from the following detailed description, taken in combination with the appended drawings, in which.

For simplicity and clarity of the illustration, elements in the drawings are not necessarily to scale, are only schematic and are non-limiting, and the same reference numbers in different figures denote the same elements, unless stated otherwise.

DETAILED DESCRIPTION

It is desirable to have an light emitting diode (LED) street lighting fixture optical system which is highly efficient and produces light distributions that conform to the guidelines of international standards organizations, and consists of a low cost single lens that facilitates ease of manufacturing and provides the possibility of field serviceable optical replacement. To meet these goals, a planar lens cover with embedded refractor lens elements is provided which can be easily replaced in a tool-less light fixture design allowing ease of replacement. The light fixture is designed for modularity, which allows for easy assembling and maintenance of the parts of the fixture. The tool-less light engine module allows for quick, tool-less replacement of a light engine module in the event of warranty replacements, future upgrades to more efficient components, or changes in user requirements. This enables a unique feature in the industry as most "replaceable" light engine modules still require the loosening or removal of several screws, which requires a tool and can be time-consuming. The light fixture is also designed to provide optics and thermal performance so that the light fixture may be used for illuminating roadways.

The present description includes, among others, by way of example only, a light assembly providing a lens cover with integrated refractor lens elements for receiving light from light emitting diodes (LED) of a light engine to produce optimal distribution which meets Illuminating Engineering Society of North America (IESNA) specifications for both luminance and illuminance levels and uniformity. The illumination pattern is selected to maximize lighting efficiency and maximize pole spacing for the above standards.

In the description below, the terms "light source" and "LED" are used interchangeably. In the description below, the terms "lens module", "lens" and "refractor" may be used interchangeably. In the description below, the terms "light engine" and "light engine module" are used interchangeably.

Figure 1:
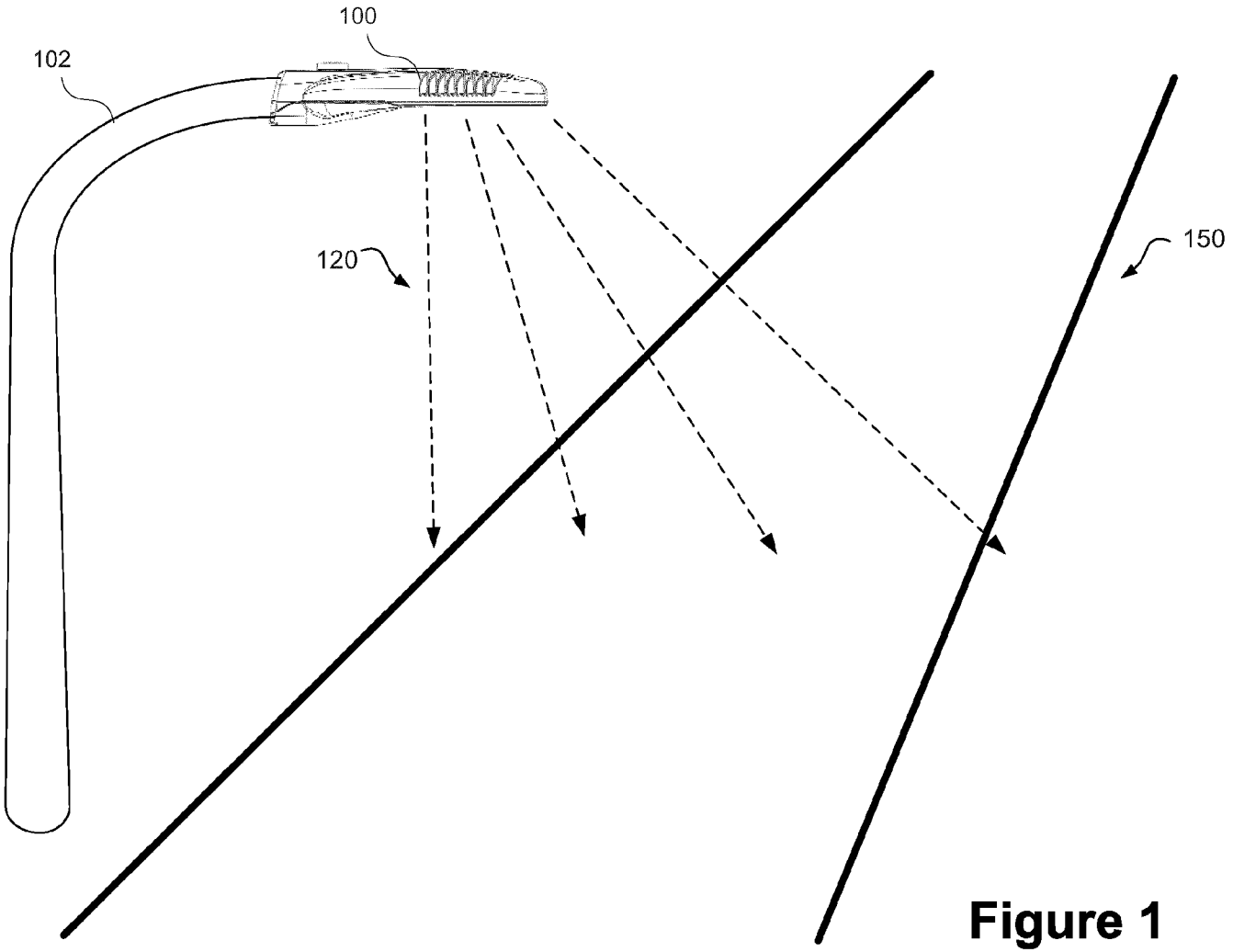
FIG. 1 is a perspective view of a light fixture with a pole in a roadway lightning application.

Referring to FIG. 1, a light fixture 100 is mounted to a pole 102 to provide illumination 120 to a surface, such as a roadway 150. The lighting fixture 100 may be implemented in a cobrahead mounting configuration using a standard pole mount; however, the fixture 100 could also be mounted in other mounting configurations, such as wall mounting or ceiling mounting. The light fixture 100 has a lighting assembly that substantially faces the roadway 150 when mounted onto the pole 102 to provide illumination 120 in a preferential direction, which in this example covers the roadway 150. Any light that is projected behind the fixture 100 in a non-preferential direction, in this example not on the roadway 150, would be wasted light. The optics of the light assembly in the light fixture 100 provides control of the light distribution of multiple light emitting diode (LED) devices to direct the light in the preferential direction.

Figure 2:
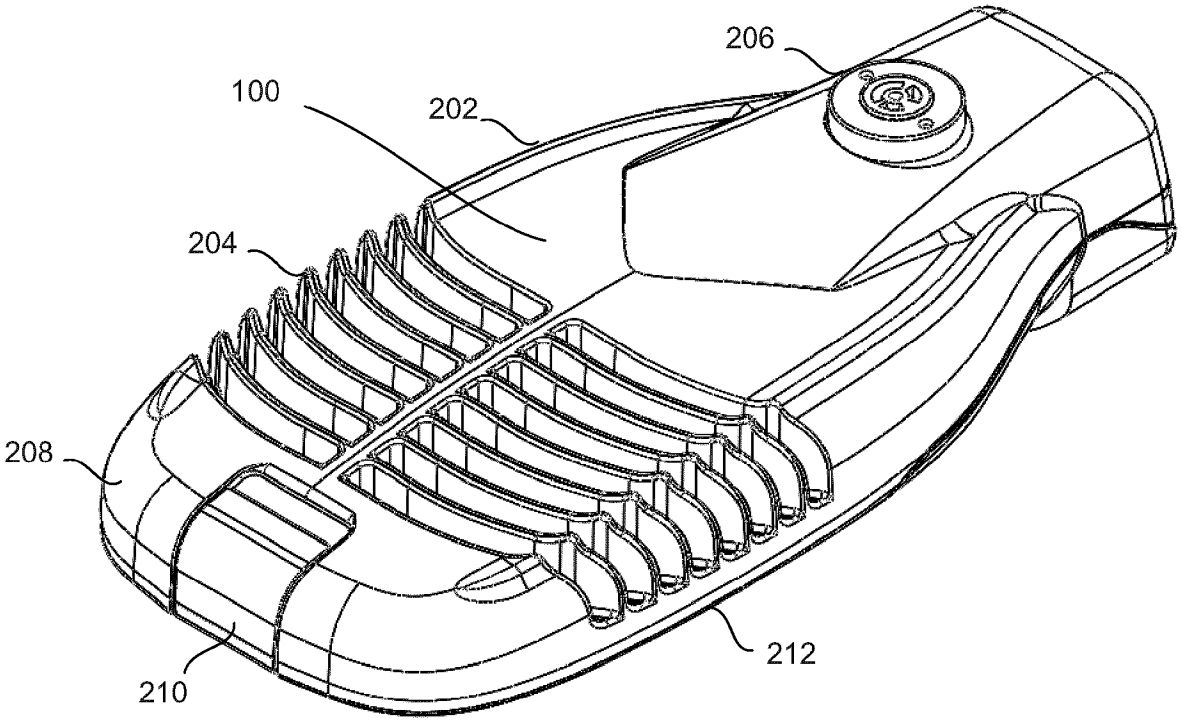
FIG. 2 is a perspective top view of the light fixture where a door latch of the top housing is in a locked position to secure a bottom cover.
Figure 3:
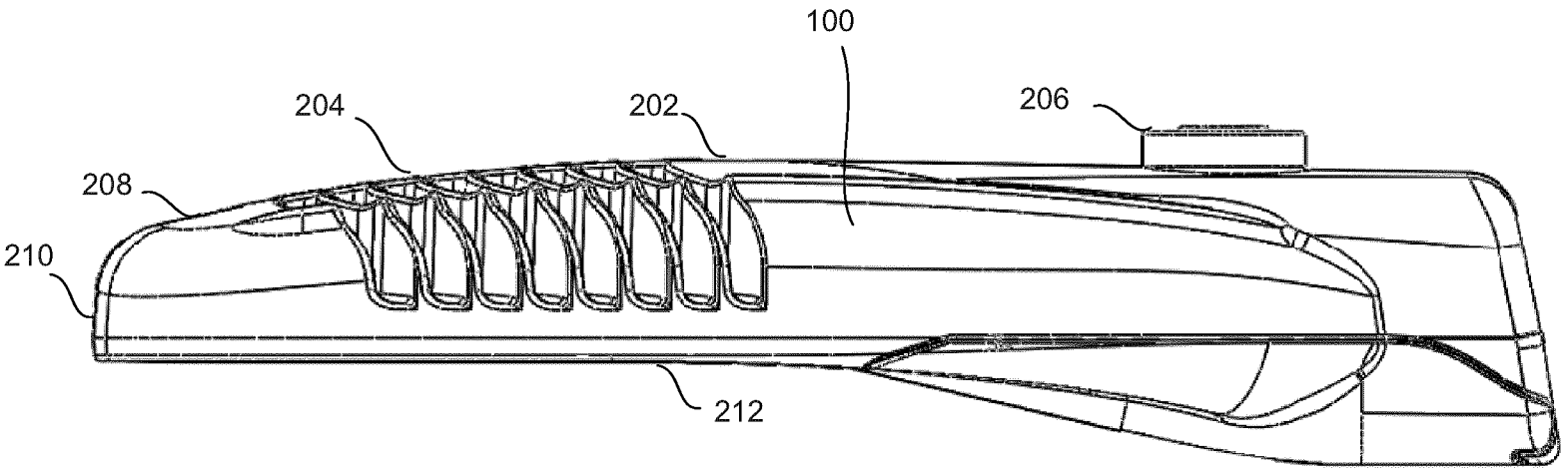
FIG. 3 is a side view of the light fixture of FIG. 2.

Referring to FIGS. 2 and 3 is a perspective top view and a side view respectively of the light fixture 100 where a door latch 210 of the top housing 202 is in a locked position to lock a bottom cover (or bottom housing) 212 with a glass insert for covering the light engine module. Light projects from the bottom cover 212 of the light fixture 100. The door latch 210 is for locking and unlocking a bottom cover 212 in the front portion 208 of the light fixture 100. The hook (or tongue) in the latch 210 is engaged with a slot or recess formed in the bottom fixture housing 802 (shown in FIG. 8). By pulling down the latch 210 it is released from the bottom cover 212. The top housing 202 also has cooling fins (or heat sinks) 204 and a receptacle 206, for receiving accessories such as a photo-sensor, global positioning receiver, a wireless control interface, or a blank filler plate.

Figure 4:
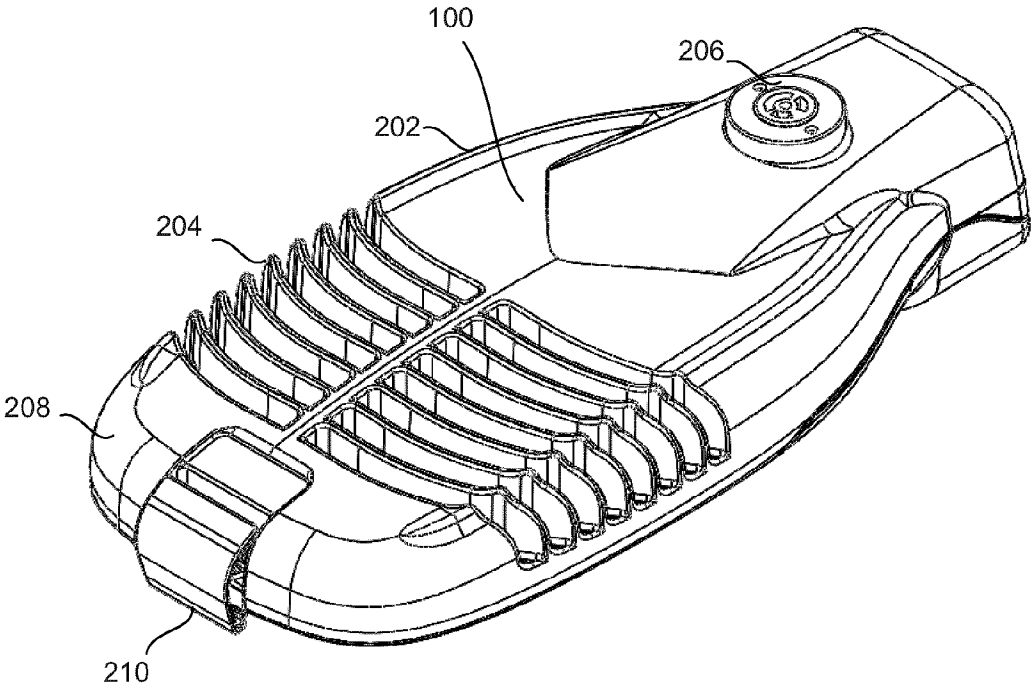
FIG. 4 is another perspective top view of the light fixture where the door latch of the top housing is in an intermediate position between the locked position and an unlocked position.
Figure 5:
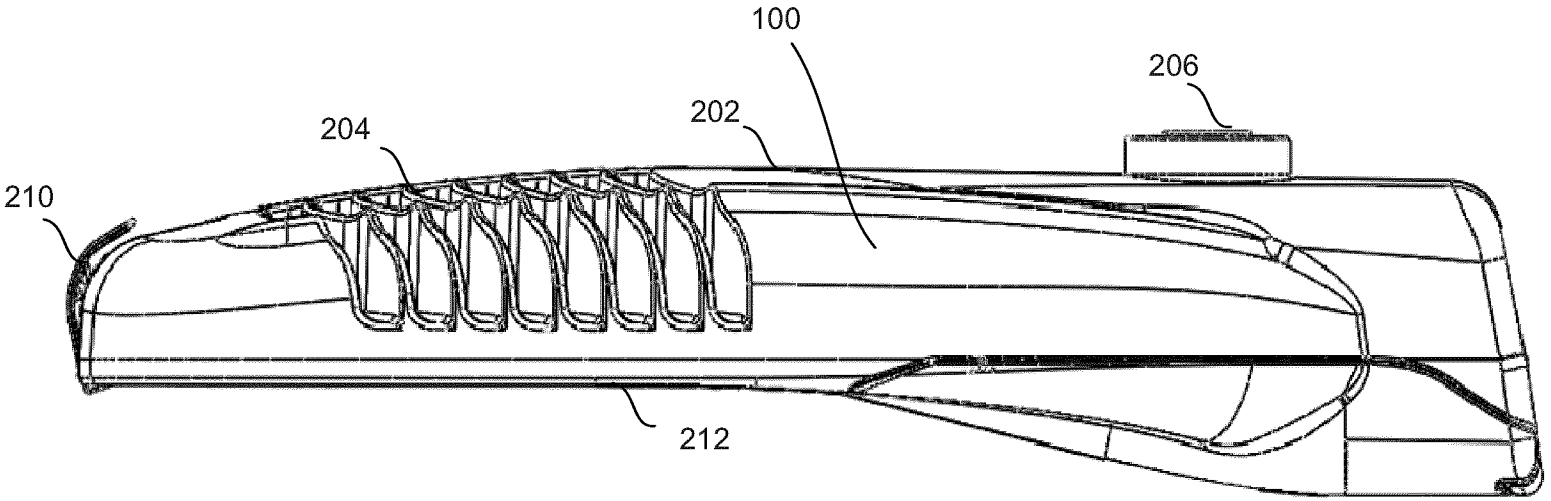
FIG. 5 is a side view of the light fixture shown in FIG. 4.

FIGS. 4 and 5 are perspective top view and side view respectively of the light fixture 100 where the door latch 210 of the top housing 202 is in an intermediate position between the locked position and an unlocked position. The door latch 210 is pulled forward to release the door latch 210.

Figure 6:
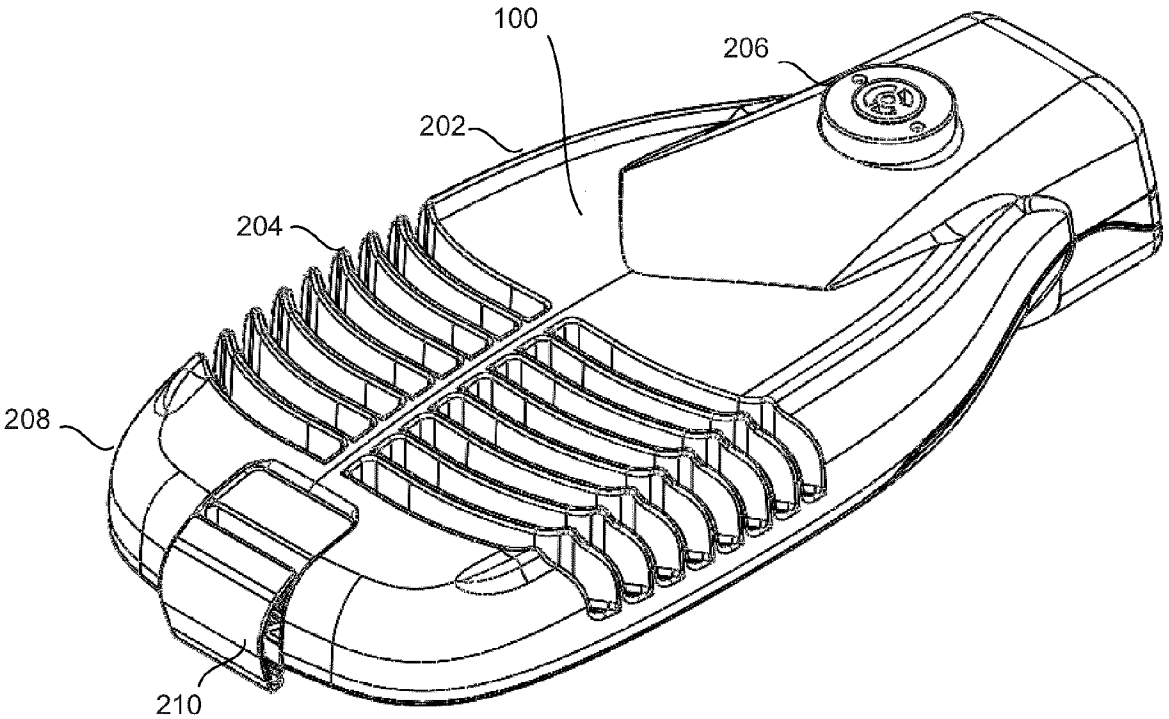
FIG. 6 is a further perspective top view of the light fixture where the door latch of the top housing is in the unlocked position to drop down the bottom cover.
Figure 7:
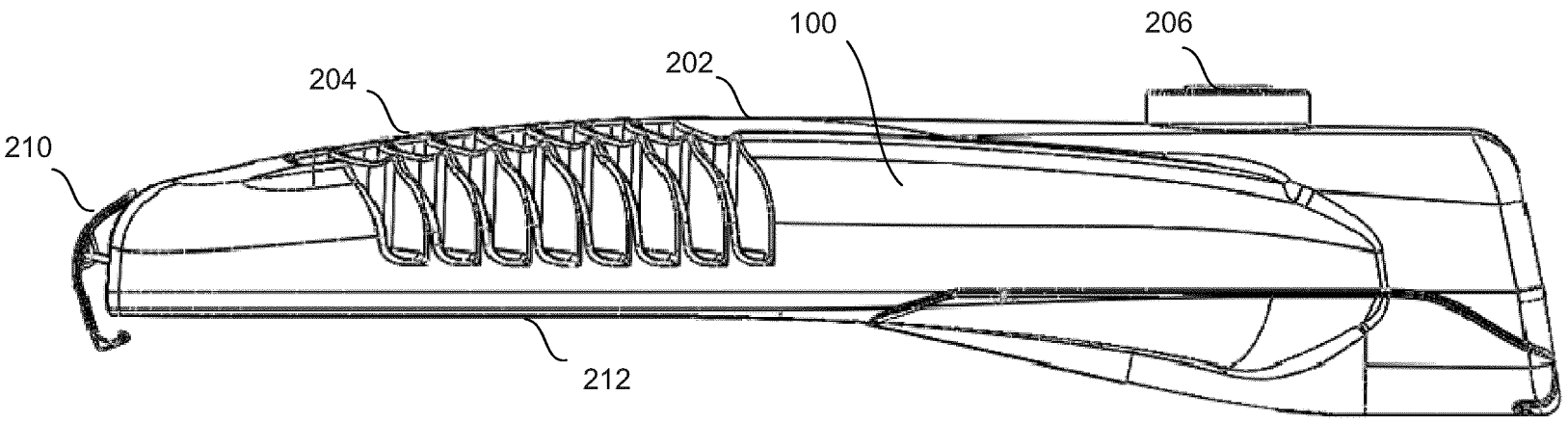
FIG. 7 is a side view of the light fixture shown in FIG. 6.
Figure 8:
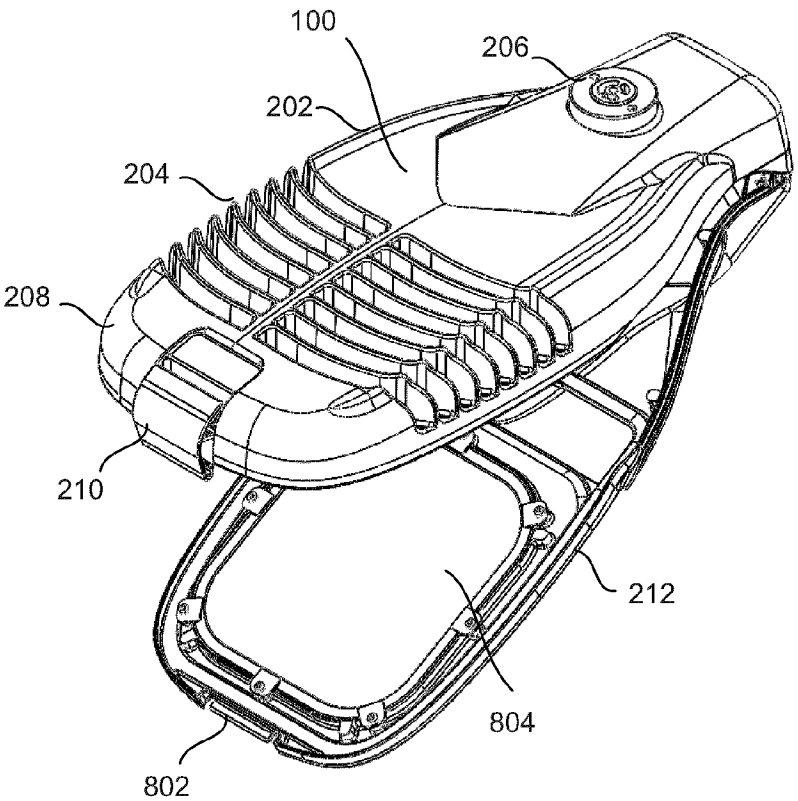
FIG. 8 is a further perspective top view of the light fixture where one end of the bottom cover is disengaged from the top housing.
Figure 9:
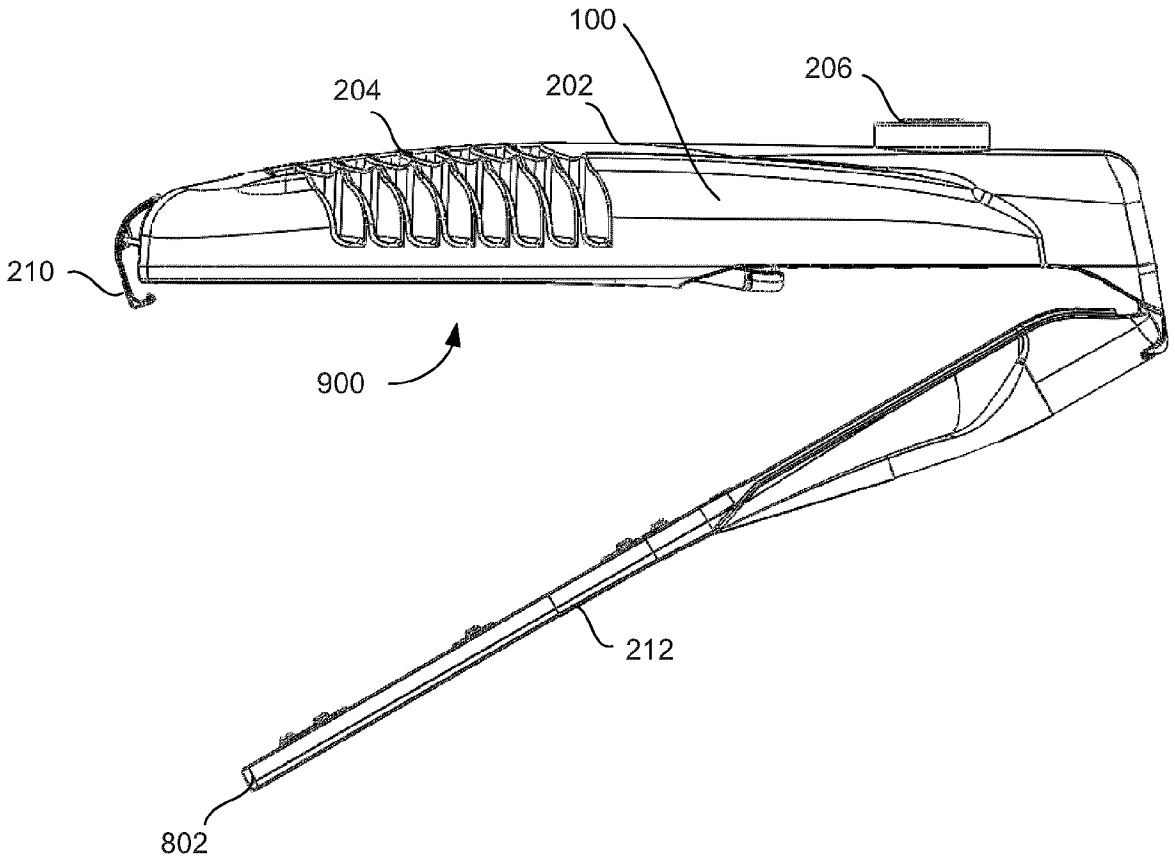
FIG. 9 is a side view of the light fixture shown in FIG. 8.

FIGS. 6 and 7 are perspective top view of the light fixture where the door latch of the top housing is in the unlocked position to drop down the bottom cover with the glass cover for the light engine module. As the door latch 210 is opened it drops downwardly and away from the light fixture body 100 and is hinged at the rear of the light fixture 100. Once the door latch 210 is released, as shown in FIGS. 8 and 9, the bottom cover 212 is disengaged from the top housing 202. The bottom cover 212 has a glass portion 804 for covering the light engine module. When the bottom cover 212 is open the light engine module 900 is accessible from underneath. To retain the bottom cover 212 the door latch 210 engages an edge or groove 802 of the bottom cover 212.

Figure 10:
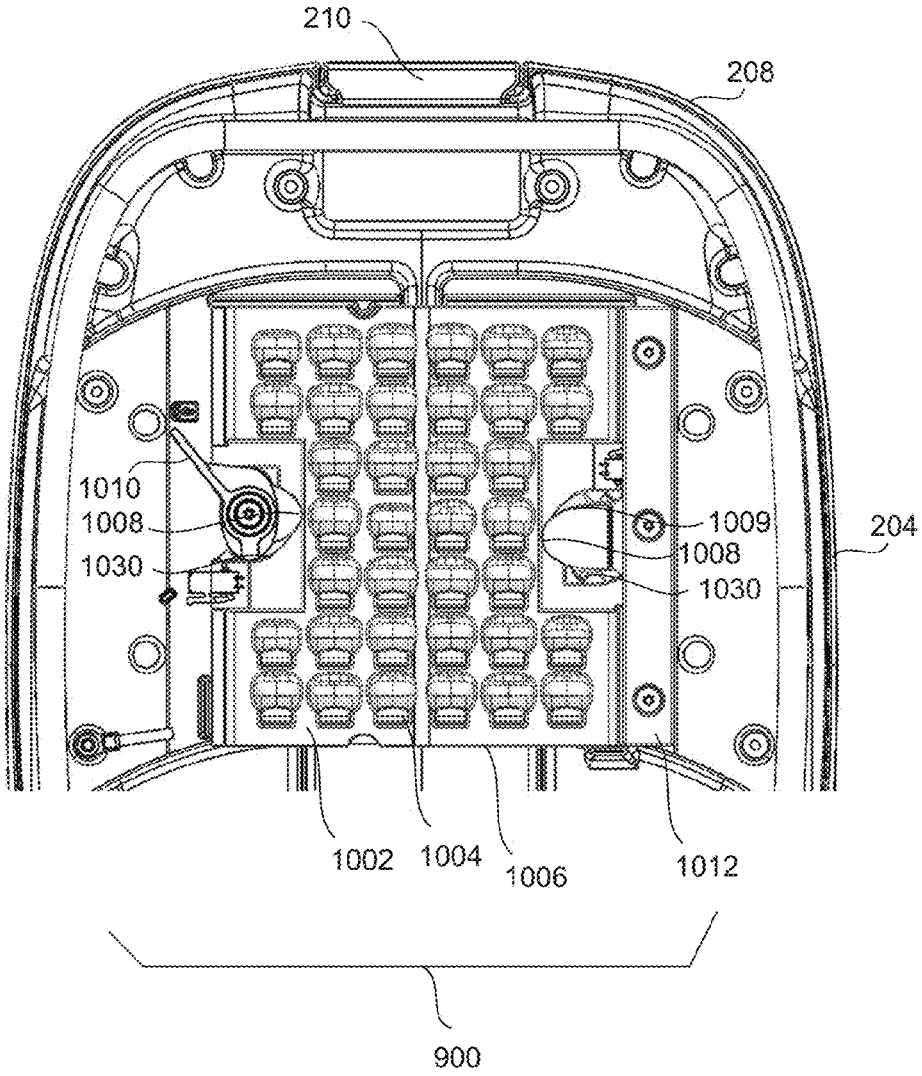
FIG. 10 is a bottom view of a tool-less light engine module and a top housing in a light fixture where a latch is in a locked position to retain a light engine module.
Figure 11:
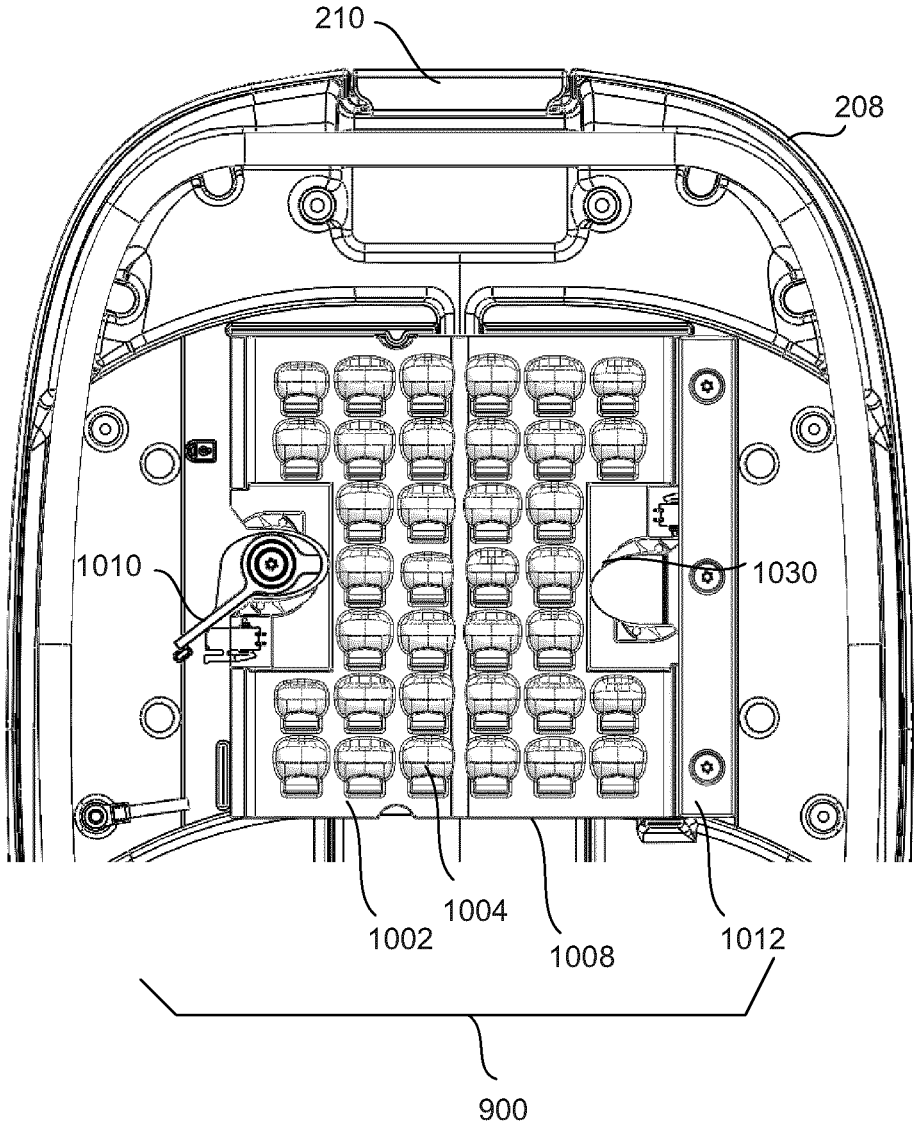
FIG. 11 is another bottom view of the tool-less light engine module and the top housing where the latch is in an unlocked position to unlock the light engine module.

FIG. 10 is a bottom view of a tool-less light engine module and a top housing in a light fixture where a latch is in a locked position to retain a light engine module. The lens cover 1002 has a plurality of refractor lens elements 1004. The light engine module 900 comprises the lens module 1002 coupled to a light engine 1006. The latch 1010 retains the lighting engine module 900 within the housing 202. The latch 1010 is received by a receiving portion 1008 in the lens module and engages the lens module 1002 at an edge 1009 to a stop position. The lens module 1002 is retained by a mounting wedge 1012 integrated into the housing 202 at the opposite side of the latch 1010. As shown in FIG. 11 the latch 1010 can be rotated to an open position and disengaging from the lens module 1002.

The light fixture 100 is designed for modularity, which allows for easy assembly and maintenance of its parts. The lens cover 1002 covers the light engine 1006 containing a printed circuit board (PCB) and multiple LEDs, at least one LED associated with a refractor lens element of the lens cover 1002. The plurality of LED light sources are mounted on the PCB. The light engine module 900 is designed so that lens cover 1002, when mounted onto the light engine 1006, provides different light patterns based upon the optical configuration of the lens cover 1002.

The lens cover 1002 is configured for directing lights towards a preferential side while minimizing wasted light towards a non-preferential side. The preferential side is a desired side to which illumination is projected. The non-preferential side is a side different from the preferential side. In a non-limiting example, at least one of the refractor lens elements 1004 of the lens cover 1002 are symmetric multi-directional lens elements. In a non-limiting example, each lens element 1004 includes a front section substantially acting as a refractive element or refractor and a backlight control section having a Total Internal Reflection (TIR) structure acting as a reflective element or a reflector. The TIR surface of the TIR structure may be coated with reflective material (e.g., reflective aluminum or metal coatings, coatings that offer the highest optical reflection with minimal losses). The front section and the backlight control section are made of material that has dimensional stability and a low coefficient of thermal expansion. In a non-limiting example, the lens elements 1004 are all constructed with the same general metrology with varying specific geometric parameters.

Each lens element 1004 may be composed of custom designed geometry on both the inner and outer surfaces as well as a backlight control structure in order to provide the desired distribution of light from the single light source. The geometry of the lens elements 1004 is designed to re-direct the light for illumination along the length of the roadway while limiting high angle light and losses through reflection in both the lens and the glass cover 804. For example, the inner curvature of the lens element 1004 consists of a series of circular and/or planar surfaces in order to redirect the light or bend the light sharply in the desired directions; and the outer curvature of the lens element 1004 consists of spherical and/or planar shapes to fine tune the distribution and minimize losses due to total internal reflection. The backlight control structure consists of one or more parabolic TIR surfaces to collect and redistribute the stray backlight towards the front of a fixture (onto the roadway) and provides maximum illumination on the roadway and therefore energy savings.

The light engine module 900 is installed in the fixture 100 so that the TIR surface of the backlight control section maximizes the amount of light collected and directed towards the illumination area and minimizes the amount of light directed at the opposite side, or area behind the fixture 100.

The light engine module 900 may be designed to have a plurality of repeating groups of lens elements 1004. The lens elements 1004 can be integrated in any repeating configuration. Each of one or more than one lens element 1004 may be different from the rest of the lens elements 1004 in the same group. Within each group, each lens element 1004 may be used to direct light to different portions of the area to be lit. The lens elements 1004 may be formed by cutting out material of the lens, or molded. Each lens element 1004 has a recess (or cavity) for receiving the corresponding LED so that the lens element 1004 collects light from the corresponding single LED. It would be appreciated by one of ordinary skilled in the art that the number of the lens elements 1004 (or corresponding LEDs) and the group configuration are not limited to those illustrated in the drawings and may vary. In a non-limiting example, the lens cover 1002 may provide a Type II or Type III light distribution pattern. Some of the lens elements 1004 may be identical to each other, or some may be different in orientation, i.e., rotated.

The mounting wedge 1012 is a fixed component that fastens to a top housing (or top cover) 202 for holding the light engine module 900. In a non-limiting example, it is made of a combination of a solid polymeric base with attached gasket compounds. The gaskets provide compressive forces to the light engine module 900 to hold one side against the housing 202. An angular interface between the light engine module 900 and the mounting wedge 1012 provides the necessary clamping force for the edge of the module without causing significant warpage. In a non-limiting example, the mounting wedge 1012 is designed to have two wedge portions along two sides of the mounting wedge 1012 member in such a manner that it can clamp the light engine module 900 from either side of the mounting wedge 1012. This allows two or more light engine modules to be mounted next to each other while using the single wedge 1012 in a larger fixture design where the mounting wedge is in the middle of the body. At least one guide rail is employed in the housing 202 to guide at least one light engine module 900 so that the light engine module will be located in its installation position within the housing 202. The guide rail may be integrated with the housing 202 or releasably engaged with the housing 202. The mounting wedge 1012 may be attached on top of the guide rail. The mounting wedge 1012 may be formed with the guide rail. A plurality of guide rails may be formed in the housing so that the light engine module is placed between the guide rails.

Opposite the mounting wedge 1012 the spring loaded cam latch 1010 is fastened to the housing 202. This latch 1010 is used to hold the other side of the light engine module 900 against the housing 202. Upon turning, the latch 1010 slides up ramps 1011 on the lens 1002 until turned substantially 90°, at which point detents on the underside of the latch 1010 fall in depressions 1030 in the lens 1002. The detents are included as a safety feature to prevent the latch 1010 from backing off due to vibration. In a non-limiting example, the detents on the underside of the latch 1010 may be angled with respect to the undersurface of the latch 1010. The cam latch 1010 may be a latch different from a spring loaded cam latch, which does not tend to pull the light engine module away from the mounting wedge.

The tool-less light engine module includes a light engine module 900, a mounting wedge 1012 and a cam latch 1010. The mounting wedge 1012 and the cam latch 1010 are designed for quick-assembling and disassembling the light engine module 900. The light engine module 900 includes a Printed Circuit Board (PCB) 1006 with any number of light sources (e.g., LEDs) and a lens module (refractor) 1002. The lens cover 1002 includes lens elements 1004, each corresponding to the LED. The PCB 1006 and the lens cover 1002 are designed to ensure that they are mated together such that each lens element 1004 is properly alighted with the corresponding LED. In a non-limiting example, the lens cover 1002 is heat staked to the PCB 1006 to hold the system together.

The light engine module 900 is a unique "I" shaped module having a latch receiving (recess) area(s) which allows the latch contact to move inward, providing a better contact profile between the light engine module 900 and the housing 202 for thermal transfer. The "I" shaped module compared to a square light engine with latching on the outer edge provides a drop in temperature at the LEDs of several degrees Celsius. Alignment features on the housing ensure that the module is located properly and can only be inserted in one orientation, so that the optics are always oriented properly relative to the fixture body.

Figure 12:
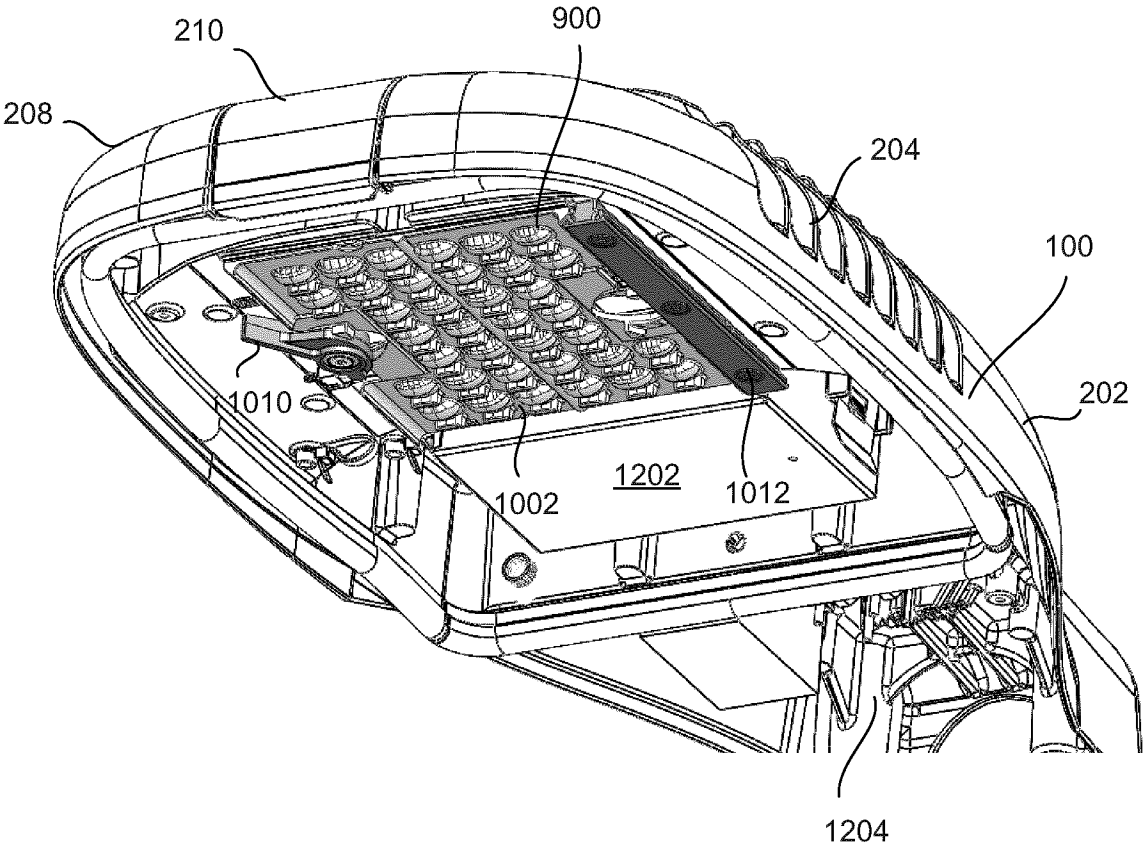
FIG. 12 is a perspective bottom view of the tool-less light engine module and the top housing.

FIG. 12 is a perspective bottom view of the tool-less engine module and the top housing of the light fixture 100. The light fixture 100 also houses a power supply 1202 positioned behind the light engine module 900. The light fixture contains a compartment 1204 at the rear of the light fixture 100 for mounting to a pole and providing wiring access to the power supply 1202 in the front compartment.

Figure 13:
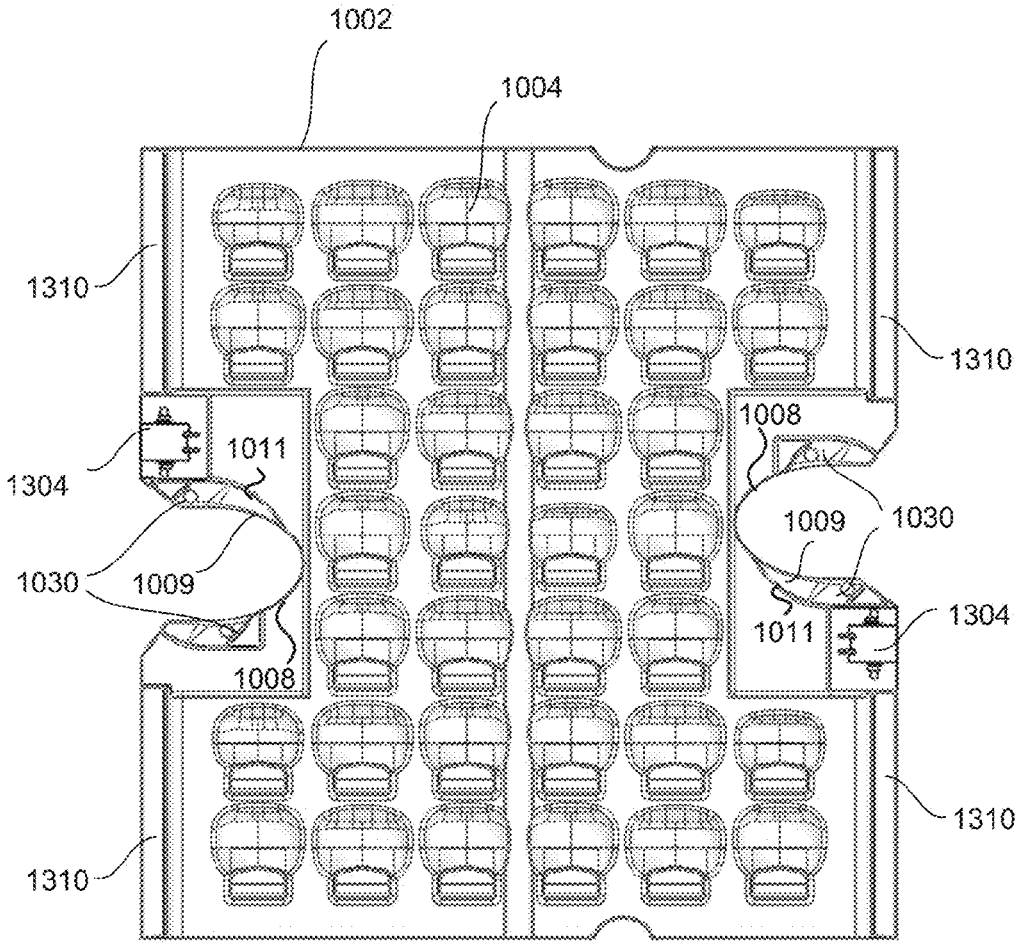
FIG. 13 is a top view of the light engine module.
Figure 14:
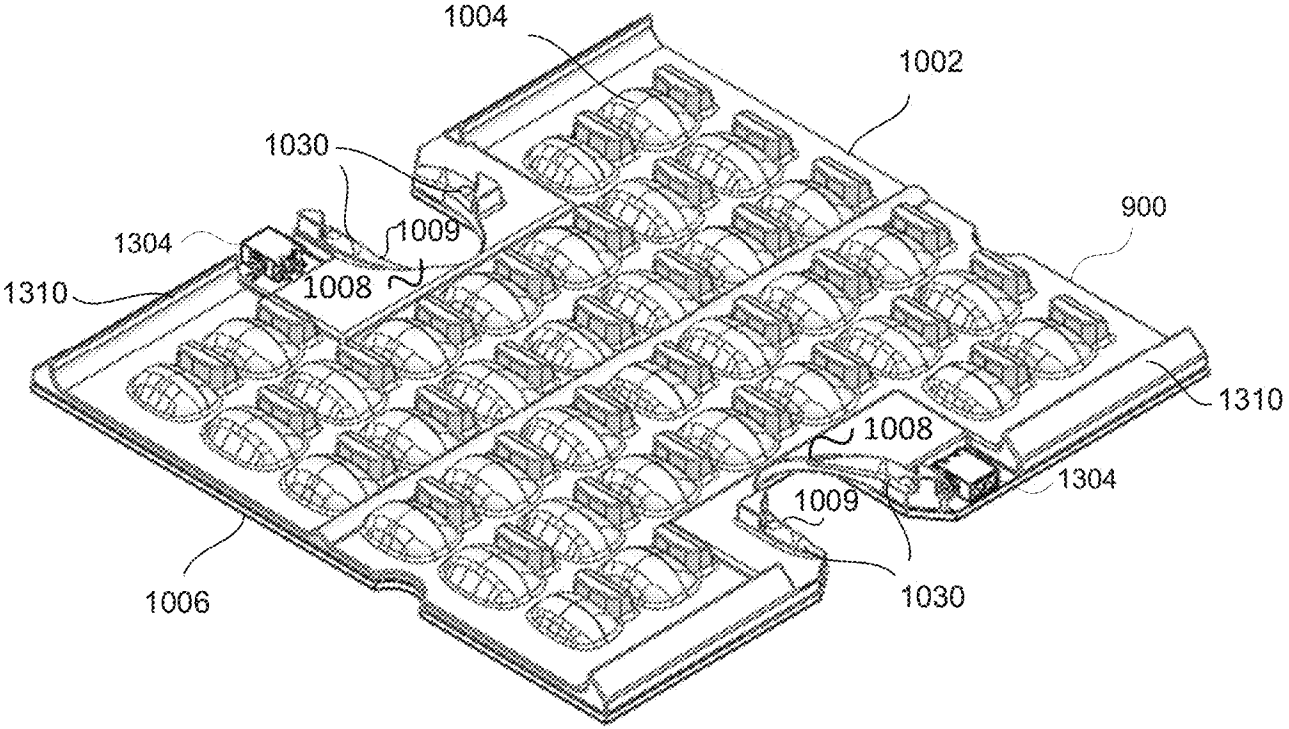
FIG. 14 is an perspective view of the light engine module.

As shown in FIG. 13 and FIG. 14, the lens cover 1002 comprises a plurality of refractor lens elements (refractive elements) 1004 which are formed integrally with a base material to provide the lens cover 1002 for the light engine module 900. The lens cover 204 and the refractor lens elements 300 may be formed from a transparent material such for example clear acrylic, such as Poly(methyl methacrylate) (PMMA), or clear polycarbonate. The lens element 1004 may be formed by cutting out material of the lens cover, or molded into the desired lens elements. Each lens element 1004 has a recess (or cavity) for receiving the corresponding light source such that the refractor lens element 1004 collects light from the corresponding light source. In a non-limiting example, the light source is a LED. In the description, the terms "lens elements", "refractive elements" and "lens elements" may be used interchangeably. The lens cover 1002 edge 1009 has a stop point 1212. The lens cover 1002 can be designed symmetrical to allow the latch 1010 to be positioned on either side of the lens cover 1002. The lens cover 1002 has a space to allow a power connector 1304 to be easily accessed. Either edge of the lens cover 1002 has edges 1310 for interfacing with the mounting wedge 1012.

Figure 15:
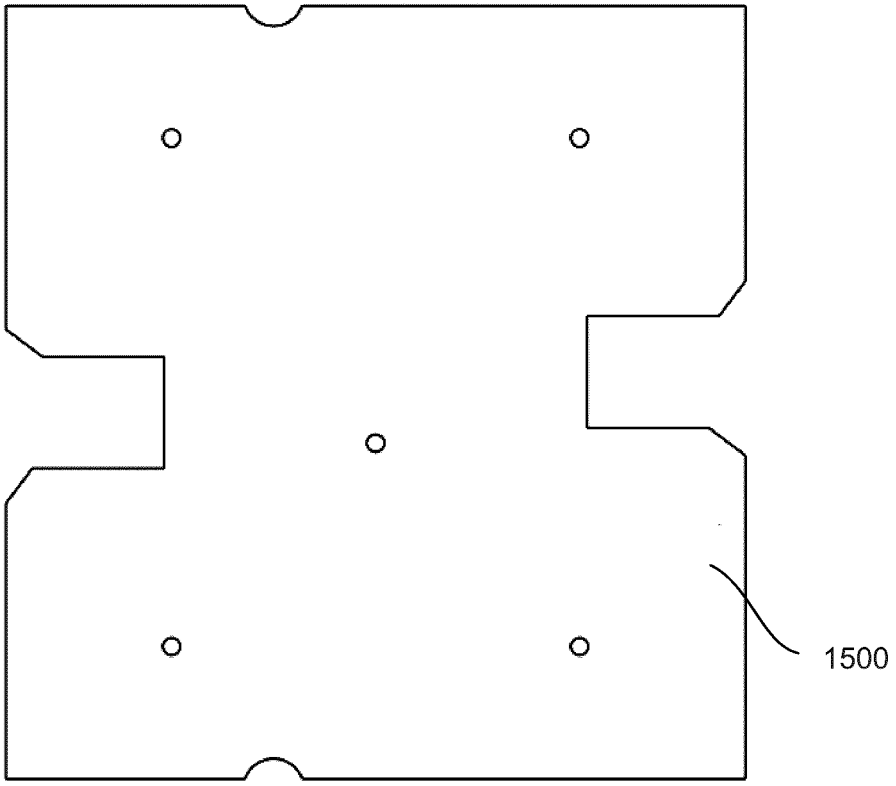
FIG. 15 is a bottom view of the light engine module.

FIG. 15 is a bottom view of the light engine module 900. The bottom of the light engine module 900 has a flat surface 1500 for transferring heat sink portion 204.

Figure 16:
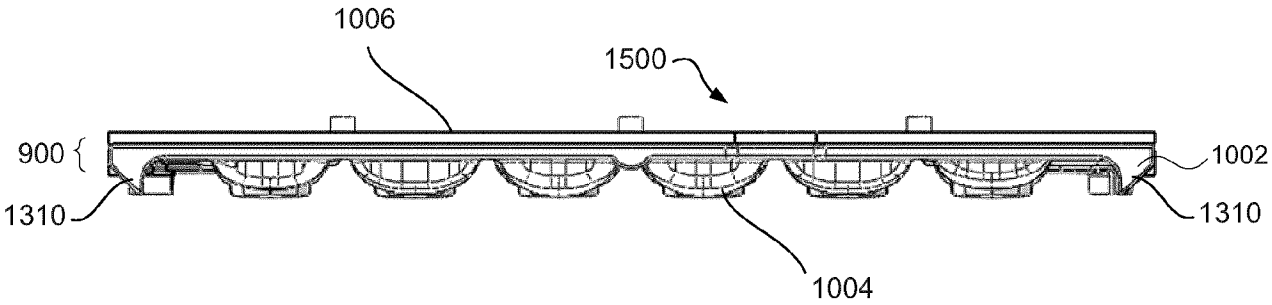
FIG. 16 is a front view of the light engine module.
Figure 17:
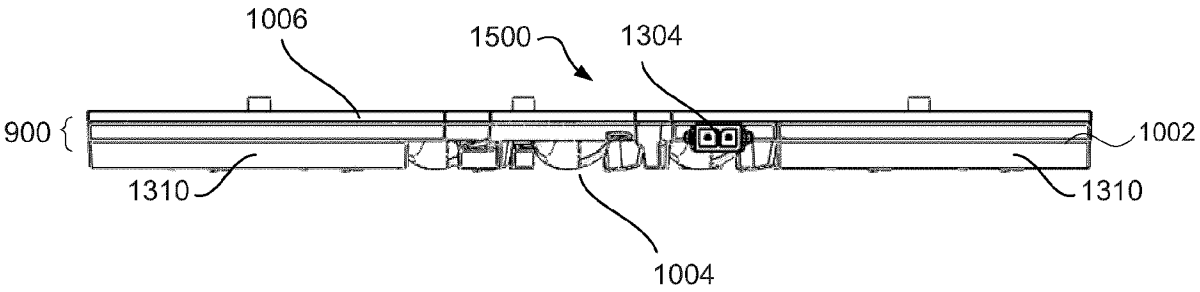
FIG. 17 is a side view of the light engine module.

FIG. 16 is a front view of and edge of the light engine module 900. FIG. 17 is a side view of the light engine module 900. The edges 1310 engage mounting wedge 1012 keeping the light engine 1006 interfaced with the lens cover 1002.

Figure 18A:
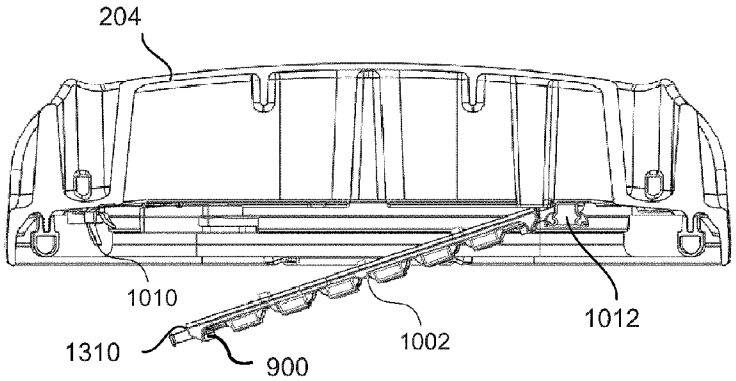
FIG. 18A is a section view of the light engine module showing installation of the light engine module in the fixture with a mounting wedge.
Figure 18B:
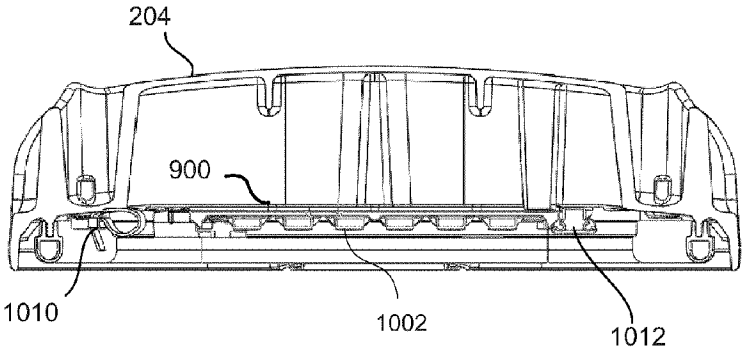
FIG. 18B is another section view of the light engine module showing interface with the mounting wedge.

FIG. 18A is a section view of the light engine module 900, showing installation approach in the light fixture 100 with a mounting wedge 1012. The light engine module 900 is placed against the mounting wedge 1012 and angled into the fixture 100. The latch 1010 is in the open position to receive the light engine module 900. FIG. 18B is another section view of the light engine module 900, showing interface with the mounting wedge 1012 with latch 1010 engaged in the locked position.

Figure 19:
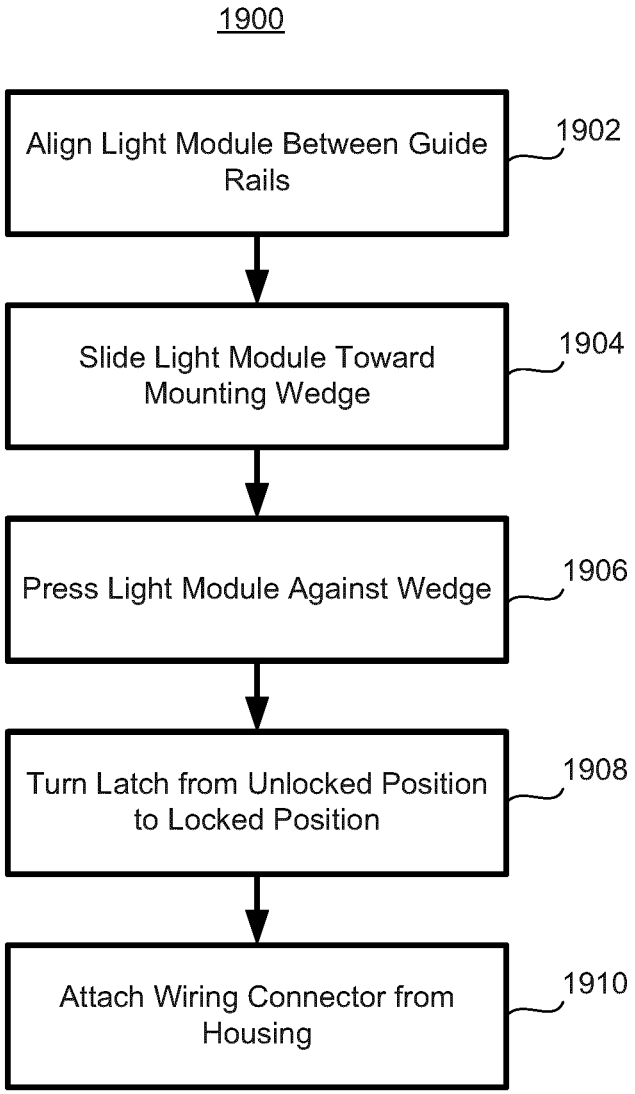
FIG. 19 is a flow chart showing the installation procedure of the light engine module.

FIG. 19 is a flow chart of a method 1900 showing the installation procedure of the light engine module 900. With the light engine module 900 oriented approximately 30°-45° to the housing 202, the light engine module 900 is aligned along a guide rail or between guide rails near the mounting wedge 1012 (1902). The light engine module 102 is slid towards the mounting wedge 1012, ensuring contact between the light engine module 900 and the housing 202 while doing so (1904). With the light engine module 900 is pressed against the mounting wedge 1012, and the cam latch 1010 in the unlocked position, push the rest of the light engine module 900 against the housing 202 (1906). The latch 1010 is turned to the locked position so that the detents of the latch 1010 fall within the depressions in the lens 1002 (1908). The wiring connector 1304 is attached from the housing 202 (1910). The housing 212 is then closed and the door latch 210 can be closed. To remove the light engine module 900 from the housing 202, the above procedure is reversed.

It would be appreciated by a person skilled in the art that the various embodiments of the present disclosure may be applicable to a variety of environments and applications, such as roadway, parking lot, sidewalk, highway, Various embodiments of the present invention may be applicable to a variety of environments and applications such as roadway, highways, tunnels, sidewalks, parking lots, indoor or outdoor facilities.

Although the above discloses example lens configuration, it should be noted that such configurations are merely illustrative and should not be considered as limiting in terms of angles, dimensions or orientations provided as other variations may be contemplated without venturing away from the intent of the disclosure. Accordingly, while the following describes example construction, persons having ordinary skill in the art will readily appreciate that the examples provided are not the only way to implement such lens configuration.

It will be appreciated by those skilled in the art that the words "during", "while", and "when" as used herein relating to circuit operation are not exact terms that mean an action takes place instantly upon an initiating action but that there may be some small but reasonable delay, such as a propagation delay, between the reaction that is initiated by the initial action. Additionally, the term "while" means that a certain action occurs at least within some portion of a duration of the initiating action. The use of the word "approximately" or "substantially" means that a value of an element has a parameter that is expected to be close to a stated value or position. However, as is well known in the art there are always minor variances that prevent the values or positions from being exactly as stated. It is to be understood that the terms so used are interchangeable under appropriate circumstances and that the embodiments described herein are capable of operation in other sequences than described or illustrated herein.

What is claimed is:

1. A light fixture comprising:

a housing for accommodating a light engine module, the light engine module comprising a lens module having a plurality of lens elements mounted on a plurality of light sources of a light emitting diode (LED) engine;

a rotatable latch engaged with the housing, the latch locking and unlocking the light engine module with the housing by being engaged and disengaged with the light engine module, the latch rotating about an axis perpendicular to the plurality of lens elements of the light engine module; and a mounting wedge fastened to the housing for aligning one end of the light engine module with a predetermined position of the housing and retaining the lens module to the LED engine when the latch is locked.

2. The light fixture according to claim 1 wherein the mounting wedge is configured to clamp the light engine module from either side of the light engine module.

3. The light fixture according to claim 1 wherein the mounting wedge provides an angular interface between the mounting wedge and the light engine module.

4. The light fixture according claim 1 comprising:

a guide rail for guiding the light engine module to slide the light engine module towards the mounting wedge.

5. The light fixture according to claim 1 wherein the lens module comprises:

a ramp section, the latch sliding up the ramp section toward a locked position.

6. The light fixture according to claim 1 wherein the latch comprises:

a detent falling into a depression in the lens module in a locked position.

7. The light fixture according to claim 1 wherein the latch is a spring loaded cam latch.

8. The light fixture according to claim 1 wherein at least one of the lens elements is symmetric about a center axis of the at least one lens element.

9. The light fixture according to claim 1 wherein the mounting wedge is composed by a combination of a solid polymeric base with gasket compounds, the gasket compounds providing compressive forces to the light engine module to hold one end of the light engine module against the housing.

10. The light fixture according to claim 1 wherein at least one of the lens elements comprises:

a backlight control structure comprising a parabolic Total Internal Reflection (TIR) surface to collect and redistribute a stray backlight towards a front of the light fixture in a locked position.

11. The light fixture according to claim 1 comprising:

a cover having pivotably engaged with a bottom of the housing to cover the light engine module.

12. The light fixture according to claim 11 wherein the housing comprises:

a door latch for locking and unlocking one end of the cover of the housing to allow access to the light engine module.

13. A light assembly for a light fixture, comprising:

a rotatable latch on a housing of the light fixture;

a lens module comprising a plurality of lens elements for a plurality of light sources from a light emitting diode (LED) engine and a receiving member for receiving the rotatable latch, the rotatable latch releasably engaged with the receiving member of the lens module to lock and unlock the lens module mounted on the plurality of light sources within the housing by rotation of the latch about an axis perpendicular to the plurality of lens elements of the lens module; and a mounting wedge on the housing opposite the latch within the light fixture, the mounting wedge aligning one end of the lens module and the LED engine with a predetermined position of the housing.

14. The light assembly according to claim 13 comprising:

a guide rail on the housing for locating the lens module in an installation position of the housing.

15. A light engine module and light fixture, comprising:

a light engine comprising a plurality of light emitting diodes (LED);

a rotatable latch on a housing of the light fixture;

a mounting wedge provided in the housing of the light fixture; and a lens cover for mating with the light engine, the lens cover having a plurality of lens elements for receiving the plurality of LEDs, the lens cover having a receiving portion on an outside edge for receiving the rotatable latch of the light fixture, the rotatable latch releasably engaged with the receiving portion of the lens cover to lock and unlock the light engine module mounted within the housing by rotation of the latch about an axis perpendicular to the plurality of lens elements of the light engine module and wherein an opposite outside edge portion of the lens cover is substantially flat to engage the mounting wedge to retain the light engine and the lens cover within the light fixture by rotation of the latch to a locking position.

16. The light engine module and light fixture of claim 15 wherein the receiving portion is formed by a recess in the lens cover and light engine module.

17. The light engine module and light fixture of claim 16 wherein the recess in the lens cover further comprises a depression for receiving a detent of the latch when in a locked position.

18. The light engine module and light fixture of claim 17 wherein the recess in the lens cover further sliding the latch upon a ramp section in the lens covers toward a locked position prior to the depression for receiving the detent.

19. The light engine module and light fixture of claim 15 wherein the lens elements of the lens cover further comprise:

a backlight control structure comprising a parabolic Total Internal Reflection (TIR) surface to collect and redistribute a stray backlight towards a front of the light fixture.

20. The light engine module and light fixture of claim 15 wherein the lens cover is made by a transparent material.

21. The light engine module and light fixture of claim 20 wherein the transparent material is a Poly(methyl methacrylate) (PMMA) or clear polycarbonate.

* * * * *